US005635790A

United States Patent [19]

Meyer et al.

[11] Patent Number: 5,635,790

[45] Date of Patent: Jun. 3, 1997

[54] PROCESS FOR THE PRODUCTION OF A MICROTIP ELECTRON SOURCE AND MICROTIP ELECTRON SOURCE OBTAINED BY THIS PROCESS

[75] Inventors: Robert Meyer, St. Nazaire; Pierre Vaudaine, Seyssins; Philippe Rambaud, Claix, all of France

[73] Assignee: Commissariat a l'Energie Atomique, Paris, France

[21] Appl. No.: 422,159

[22] Filed: Apr. 14, 1995

[30] Foreign Application Priority Data

| | | | |
|---|---|---|---|
| Apr. 25, 1994 | [FR] | France | 94 04948 |
| Nov. 22, 1994 | [FR] | France | 94 13972 |

[51] Int. Cl.[6] ..... H01J 9/02

[52] U.S. Cl. ..... 313/309; 445/50

[58] Field of Search ..... 445/24, 50; 313/309, 313/336, 351

[56] References Cited

U.S. PATENT DOCUMENTS

| | | | |
|---|---|---|---|
| 4,940,916 | 7/1990 | Borel et al. | 313/306 |
| 5,194,780 | 3/1993 | Meyer | 313/309 X |
| 5,203,731 | 4/1993 | Zimmerman | 445/50 |
| 5,225,820 | 7/1993 | Clerc | 340/752 |

FOREIGN PATENT DOCUMENTS

| | | |
|---|---|---|
| 0 234 989 | 9/1987 | European Pat. Off. . |
| 0 434 330 | 6/1991 | European Pat. Off. . |
| 0 443 920 | 8/1991 | European Pat. Off. . |
| 0 535 953 | 4/1993 | European Pat. Off. . |
| 0 570 211 | 11/1993 | European Pat. Off. . |
| 2 593 953 | 1/1986 | France . |

OTHER PUBLICATIONS

Microelectronic Engineering, vol. 13, No. 1/4, pp. 505–508, Mar. 13 1991, D. Stephani, et al., "Microfabrication of Metal–Coated Silicon Tips and Their Field Emmission Properties".

Applied Physics Letters, vol. 63, No. 1, pp. 33–35, Jul. 5, 1993, P.R. Schwoebel, et al., "Field–Emitter Array Performance Enhancement Using Hydrogen Glow Discharges".

*Primary Examiner*—Kenneth J. Ramsey

*Attorney, Agent, or Firm*—Oblon, Spivak, McClelland, Maier & Neustadt, P.C.

[57] ABSTRACT

A process for the production of microtip electron sources and the products produced thereby. The process includes a first cleaning stage with a first wet chemical cleaning substage and/or a second plasma cleaning substage and a finishing stage using surface etching. A second cleaning stage using a wet chemical cleaning can also be used. The process uses a system of cathode conductors, grids superimposed an intermediate insulator and microtips deposited on the cathode conductors.

20 Claims, 4 Drawing Sheets

PROCESS FOR THE PRODUCTION OF A MICROTIP ELECTRON SOURCE AND MICROTIP ELECTRON SOURCE OBTAINED BY THIS PROCESS

The present invention relates in general terms to emissive cathode systems using field effect electron emission such as e.g. those of flat matrix screens used for image display purposes. It more specifically relates to a process making it possible to improve the characteristics of microtip cathodes and their uniformity on large surfaces.

Such an emissive microtip system and its production process are e.g. described in detail in FR-A-2 593 953 of 24.1.1986. Reference will firstly be made to the known procedure for producing such microtips in a structure of this type, such as can be gathered from the aforementioned document with reference to the attached FIGS. 1, 2 and 3.

FIG. 1 shows an already produced structure comprising on a substrate 6 surmounted by an insulator 7, a system of cathode conductors 8 and grids 10*a* superimposed in crossing manner with an intermediate insulator 12 and an e.g. nickel layer 23 deposited on the surface to serve as a mask during the microtip production operations. This nickel layer 23, the grids 10*a* and the insulator 12 have holes 16, in the bottom of which are to be deposited the future microtips constituted by a conductor metal in electrical connection with the cathode electrode 8.

For the production of the microtips, the following procedure is adopted with reference to FIG. 2 . Firstly, e.g. deposition takes place of a molybdenum layer 18*a* on the complete structure. This layer 18*a* has a thickness of approximately 1.8 μm. It is deposited under normal incidence with respect to the surface of said structure. This deposition procedure makes it possible to obtain molybdenum cones 18 located in holes 16 with a height of 1.2 to 1.5 μm. This is followed by the selective dissolving of the nickel layer 23 using an electrochemical process in such a way as to free, in the manner shown in FIG. 3, the e.g. niobium perforated grids 10*a* and bring about the appearance of the electron emitting microtips 18.

To within a few technological variants, the known method described relative to FIGS. 1, 2 and 3 is still that which is used at present for producing the microtips of emissive cathode systems. Unfortunately, the thus obtained microtips suffer from certain deficiencies, which firstly result from the fact that the aforementioned method makes it difficult to obtain microtips having a reproducible shape between the individual tips and/or between individual cathodes, particularly over large surfaces during mass production. They also result from the fact that on the one hand the microtips obtained are far from always having the perfect conical shape illustrated under the reference 18 in FIGS. 2 and 3. Thus, they usually have inequalities of shape and majority have a much greater radius of curvature, which gives them a dome profile, as can be seen in FIG. 4. This dome profile significantly decreases their emissivity, i.e. the current density emitted for a given microtip grid voltage. On the other hand, the production of the cathode requires at least one photolithography stage which takes place after the production of the tips and more particularly for defining conductive strips forming the grids. This stage creates significant pollution risks on the tips (organic residues, cleaning traces, etc.).

The emissivity of a tip varies exponentially with the shape of the tip and its surface state.

Under these conditions, only a small proportion of the microtips ensures the electron current of the system and consequently the mean effect is not very satisfactory and the emission is not uniform over the complete cathode.

According to EP-A-434330, it is known to etch the tips after production in order to improve their radius of curvature. However, this process is not particularly appropriate for cathodes with large surfaces.

DESCRIPTION OF THE INVENTION

The resent invention specifically relates to a process for the production of microtip electron sources making it possible both to render uniform the surface state and improve the geometry of the microtips.

Thus, by greatly reducing the dispersions of the characteristics between individual points and individual sources, this process makes it possible to obviate the aforementioned disadvantages and makes easier the production of microtip cathodes having uniform, reproducible characteristics, as well as a high emission level.

More specifically, the present invention relates to a process for the production of a microtip electron source comprising a system of cathode conductors, superimposed grids with an intermediate insulator and microtips, the grids being geometrically located between a lower plane and an upper plane and characterized in that the microtips are subject to a first cleaning stage and then to a finishing or improving stage by surface etching.

In other words, following the production of the microtips in the manner e.g. explained in FR-A-2 593 953, the invention proposes initially carrying out a first cleaning stage making it possible to render uniform the surface state and then, a finishing or improving stage consisting of a complementary etching in order to give to the microtips a profile which is as close as possible to the desired ideal, i.e. with a radius of curvature which is as small as possible (smaller than a few dozen nanometres).

In practice, this optimization consists of seeking for the microtips a profile which is as close as possible to a cone with a tapered point or tip. In other words the aim is to obtain an increased tip effect in order to ensure a considerable amplitude of the electrical field.

Advantageously, the finishing stage is followed by a second cleaning stage consisting of a wet chemical cleaning.

Preferably, the first cleaning stage involves a first wet chemical cleaning substage and a second cleaning substage using a plasma, e.g. an 0-2 plasma.

According to the invention, the surface etching finishing stage can be performed by any random known method such as controlled chemical or electrochemical etching, reactive ionic etching and ionic bombardment.

According to a feature of the process according to the invention, the surface etching of the microtips takes place over a thickness of a few dozen to a few thousand Angström.

One of the advantages of the process according to the invention is that it applies to the treatment of very large emissive surfaces, such as are in particular encountered in flat display screens. Thus, the process makes it possible to very simply correct the approximate shape of the microtips obtained up to now and, by eliminating the dispersions in the emission characteristics between individual tips, leads to a very high electron emission level much better than in the prior art, so that it makes it also possible to reduce the supply voltage which is necessary between the grids and the cathode conductors in order to extract the electrons.

Thus, the principle of the invention consists of choosing a method for producing the microtips giving for the latter an approximate shape (easier to produce over large surfaces and also less expensive), followed by the cleaning of the microtips and finally improving and homogenizing their radius of curvature with the aid of reactive ionic etching and other chemical or electrochemical etching methods.

The invention can be performed particularly advantageously when the microtips are made from at least two parts:

- a first part serving as a base and which is essentially truncated cone-shaped and is constituted by a first conductor material chosen in such a way that it is not or is only very slightly etched by the finishing stage,
- a second part constituting the actual tip and which is deposited on the first part, said second part being constituted by a conductor material chosen in such a way that it is etched by the finishing stage.

The term "conductor material" also covers semiconductor materials.

Preferably, the first part (base) has a height such that its apex is roughly at the same level as the lower plane of the grid.

The interest of performing the invention in this particular case will now be described. When the microtips are made from a single material sensitive to the refining stage, the refining time must be controlled. Thus, if it is excessive the apex of the tip can rapidly be below the lower plane of the grid, which is very unfavourable for electron emission. If it is inadequate, the radius of curvature is not at an optimum and the sought effect for the finishing stage is not achieved.

However, when the microtips are formed from two parts in the manner described hereinbefore, the finishing time must be adequate to obtain the optimum radius of curvature of the tip, but if it is longer, the apex of the tip still remains above the lower plane of the grid, because it rests on the unetched or slightly etched material.

According to an embodiment, the first part is of niobium (Nb) and the second part of molybdenum, chromium, silicon, iron or nickel.

The invention also relates to a microtip electron source comprising a system of cathode conductors, superimposed grids with an intermediate insulator and microtips deposited in holes made in the grids and the insulator, the grids being geometrically located between a lower plane and an upper plane, characterized in that the microtips respectively comprise at least two parts:

- a first, truncated cone-shaped part of height H and made from a first conductor material,
- a second part, which constitutes a conical tip and which is deposited on the first part and made from a second conductor material, the first and second materials being chosen in such a way that the second material can be finished or improved by a selective etching with respect to the first material, said etching being controlled chemical or electrochemical etching, reactive ionic etching or ionic bombardment.

Preferably, the height H is such that the apex of the first part is substantially level with the lower plane of the grids.

Thus, the invention applies to sources in which the microtips are not directly deposited on the cathode conductors, but are e.g. deposited on a resistive layer intercalated between the microtips and the cathode conductors.

BRIEF DESCRIPTION OF THE DRAWINGS

The invention is described in greater detail hereinafter relative to non-limitative embodiments and with reference to the attached drawings, wherein show.

DETAILED DESCRIPTION OF THE EMBODIMENTS

Figure 1:
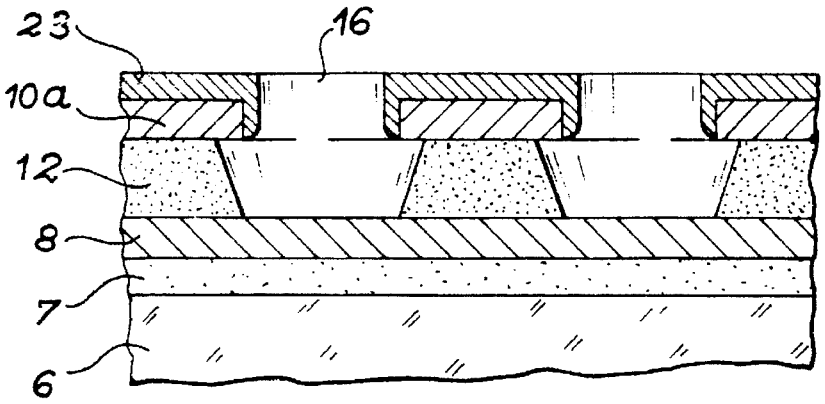
FIGS. 1 to 3 Different stages in the formation of microtips according to a prior art process.
Figure 2:
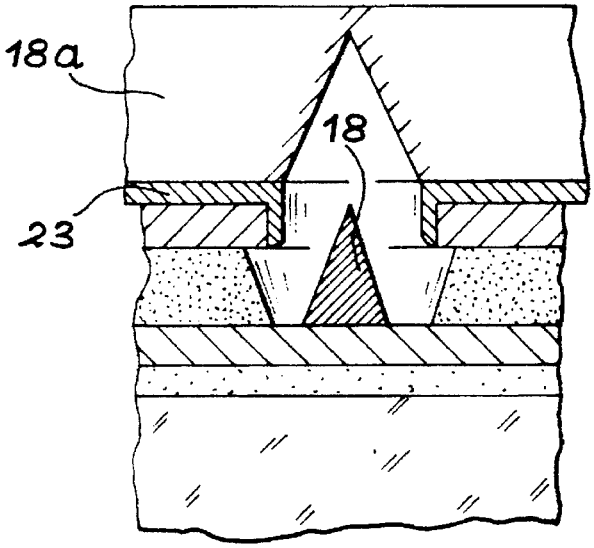
Figure 3:
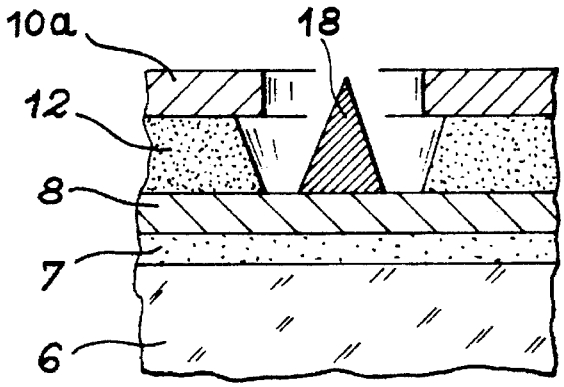
Figure 4:
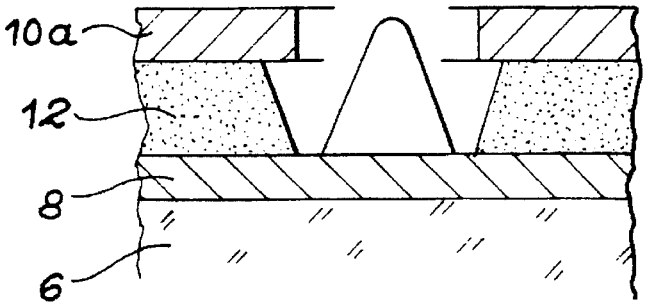
FIG. 4 Diagrammatically the shape of the microtips obtained by a known process.

The stages of the process according to the invention complete the known processes for the formation of cathodes having electron emitting microtips. Such a process is e.g. described in FR-A-2 593 953 (corresponding U.S. Pat. No. 4,857,161). In summary, it involves the following stages:

- deposition by cathodic sputtering on the substrate 6 of a silicon oxide layer 7 (cf. FIG. 1) of approximate thickness of 100 nm,
- deposition by cathodic sputtering on the layer 7 of a first indium oxide conductive layer in which will be formed the cathode conductors 8 (approximate thickness 160 nm),
- etching the first conductive layer to form first parallel conductive strips or cathode conductors 8,
- chemical vapour deposition (from silane, phosphene or oxygen gases) of a second silicon oxide insulating layer of approximate thickness 1 μm (12),
- vapour deposition on the silicon oxide layer of a third conductive layer, in which will be formed the grids 10*a* (niobium, approximate thickness 0.4 μm),
- opening of holes 16 (approximate diameter 1.3 μm) in the third conductive layer by reactive ionic etching (RIE) using a $SF_6$ plasma, and in the second layer 12 by reactive ionic etching in a $CHF_3$ plasma or chemical etching in a solution of hydrofluoric acid and ammonium fluoride,
- vapour deposition of a nickel layer 23 (FIG. 2) under grazing incidence with respect to the surface of the structure, the angle α formed between the vaporization axis and the surface of the layer 10*a* being close to 15° and the nickel layer has an approximate thickness of 150 nm,
- formation of microtips by a process described in conjunction with FIGS. 2 and 3 at the beginning of the present application,
- etching the third layer to form second conductive strips parallel to the grids.

According to the invention, these stages are firstly followed by a cleaning stage, whose function is to render uniform the surface state before any other stage. This cleaning stage can consist of two substages:

- a wet chemical cleaning in a lye bar (10% $TFD_4$ in water), at 60° C. and assisted by ultrasonics, which in all lasts approximately 5 minutes,
- cleaning by reactive ionic etching in an oxygen plasma, e.g. using equipment commercially sold under the trade name Nextral 550.

The latter operation lasting about 10 minutes, e.g. takes place with a power of 250 watts, a plasma pressure of 100 millitorrs and a flow rate of 100 $cm^3$/mn.

Figure 5:
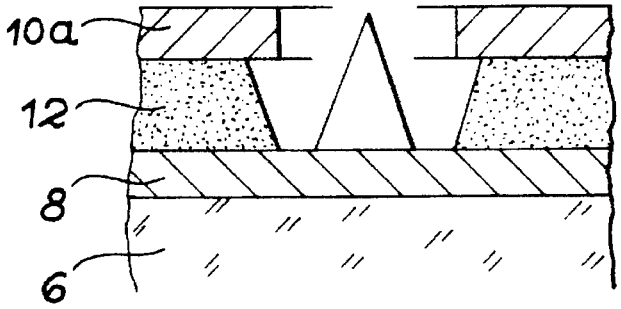
FIG. 5 Diagrammatically the desired, ideal cone profile.

The cleaning stage is followed by a tip etching or finishing stage, e.g. in the case of molybdenum tips by reactive ionic etching in a $SF_6$ plasma (same equipment as mentioned hereinbefore). This stage makes it possible to eliminate a molybdenum oxide layer which may have formed at the time of cleaning under the $O_2$ plasma. It also permits an etching of the microtips making it possible to modify their shape and in particular reduce their radius of curvature. The action conditions of the sulphur hexafluoride plasma are e.g. as follows. The operation lasts about 20 seconds with a power of 400 W, a flow rate of 40 $cm^3$/mn and under a plasma pressure of 30 millitorrs. At the end of this treatment, a high proportion of the microtips have the same profile which is like the ideal conical profile of FIG. 5 and also have a very uniform surface state.

Figure 6A:
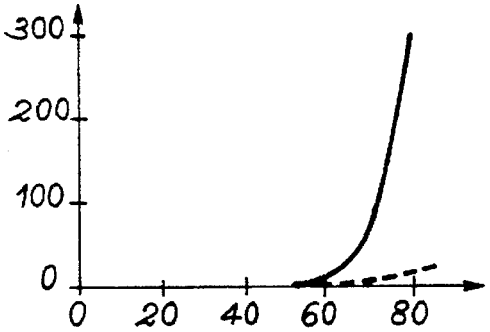
FIGS. 6*a* and 6*b* The emissivity of the microtips on the one hand before and after finishing treatment and on the other before and after the second cleaning stage.

FIG. 6*a* is a graph showing the emissivity of the microtips before the finishing treatment (dotted line curve) and after the finishing treatment (continuous line curve). In this graph, the current density in microamperes per square millimetre is plotted on the ordinate and the grid-microtip voltage in volts is plotted on the abscissa. The increase in the emissivity as a result of the treatment is clearly considerable. Thus, microtips are obtained for which the radius of curvature of the end is less than a few dozen nanometres.

Figure 6B:
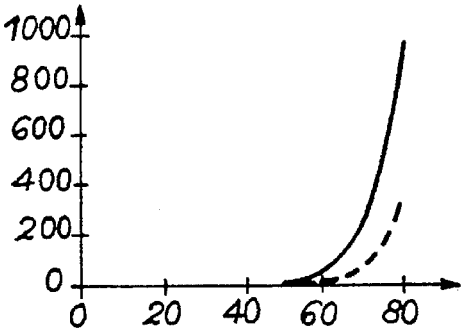

FIG. 6*b* shows the emissivity (same units as in FIG. 6*a*) of the microtips after finishing, but before (dotted line curve) and after the second cleaning stage (continuous line curve). It can be seen that this second cleaning stage further improves the emissivity to a significant extent.

Other tip finishing processes can be used alternatively to that described hereinbefore, e.g. controlled chemical or electrochemical etching or ionic bombardment.

Advantageously, the second wet, chemical cleaning stage can be performed in the aforementioned lye bar for approximately 30 minutes.

The time during which the finishing stage is performed must be controlled in the case where the microtips are made from a single metal, which is sensitive to the finishing operation, e.g. molybdenum.

Figure 7A:
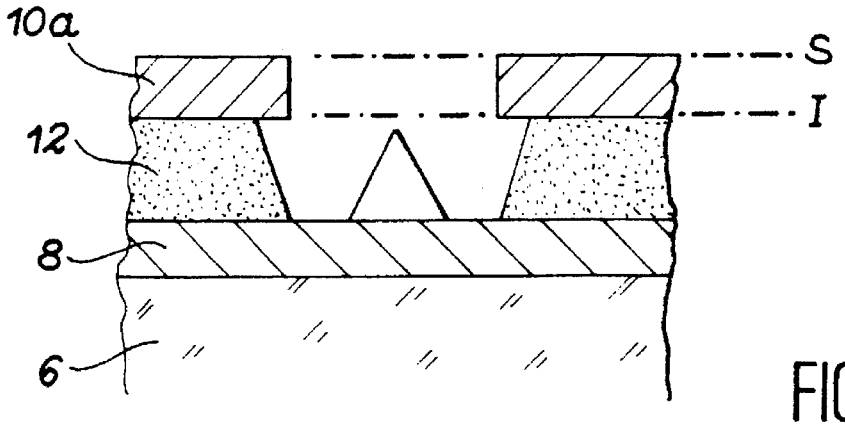
FIGS. 7*a*, 7*b* and 7*c* Diagrammatically the shapes obtained for a microtip made from a single material, respectively in the case of excessive, inadequate and optimum finishing.
Figure 7B:
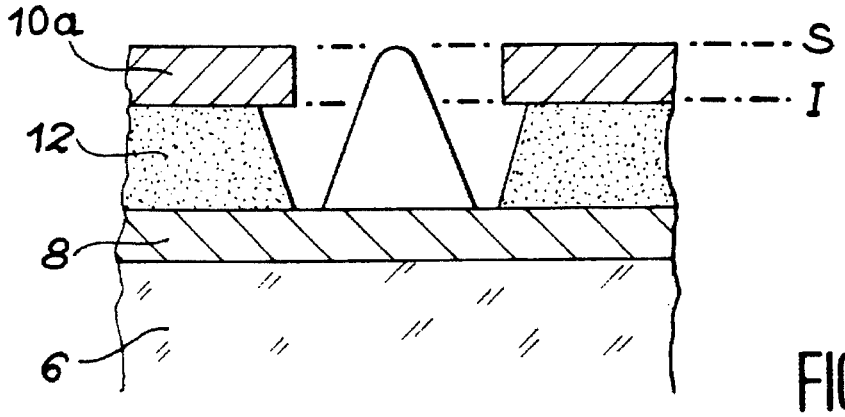

The grid 10*a* is geometrically located between or defined by two planes, namely a lower plane (I) and an upper plane (S) (cf. FIG. 7*a* in which, as in FIGS. 7*b*, 7*c*, 8*a–c*, the references 6, 8, 10*a*, 12 have the same meanings as in FIGS. 1 to 5).

If the finishing time is excessive, the apex of the tip 18 can be rapidly located, in the manner illustrated in FIG. 7*a*, below the lower plane I of the grid 10*a*, which is very unfavourable for emission. If the finishing time is inadequate, the radius of curvature is not of an optimum nature (cf. FIG. 7*b*) and the sought effect is not achieved.

Figure 7C:
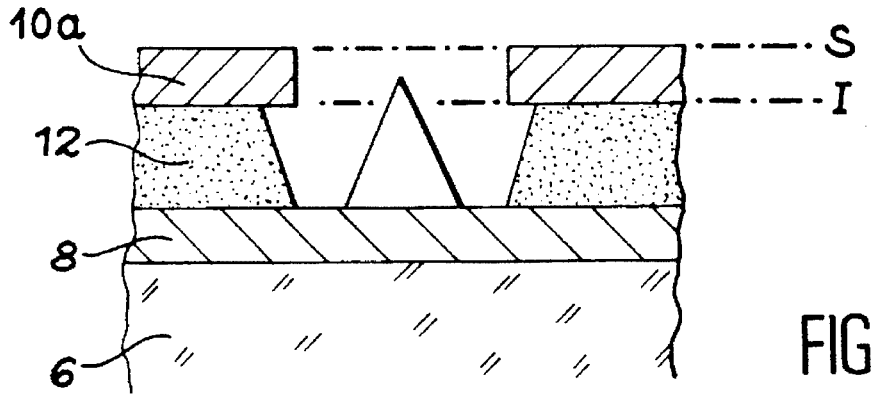

Thus, with a structure made from a single metal, the finishing time must be sufficiently long to obtain the optimum radius of curvature, but not too long so that the tip remains above the lower plane I of the grid (FIG. 7*c*).

However, when the tip is made from at least two superimposed metals, as will be seen, the finishing time is much less critical.

Figure 8A:
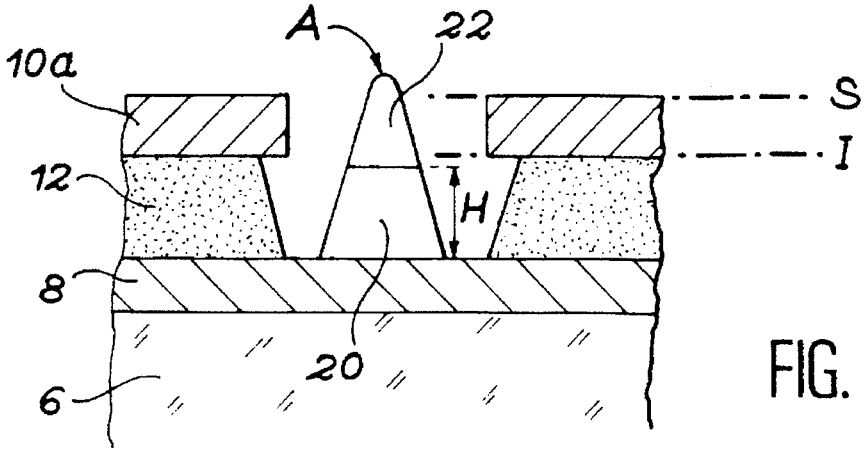
FIGS. 8*a* to 8*c*The finishing process for a two-part microtip.

The structure of the tip, before finishing, is illustrated in FIG. 8*a* and comprises:

- a first part or base 20, which is truncated cone-shaped and of height H, being formed from a first metal chosen in such a way that it is not or is only very slightly etched by the aforementioned refining stage and said material can e.g. be niobium;
- a second part 22 forming the actual tip, which is deposited directly on the first part and is made from a second material sensitive to the finishing stage, e.g. molybdenum, chromium (Cr), silicon (Si), iron (Fe) or nickel (Ni).

A process for obtaining microtips having this structure is derived from the process described hereinbefore for the production of microtips made from a single material. The first stage is to bring about the deposition of a layer 18*a*, e.g. of niobium, on the nickel layer 23, by vapour deposition under normal incidence, as in FIG. 2. There is a direct relationship between the height of material deposited in the hole 16 and the vapour deposition time. Thus, said vapour deposition can be interrupted when the desired height H of the truncated cone forming the base 20 is reached and the vapour deposition can then be continued with the second material, such as molybdenum, so as to obtain the second part 22. The assembly then has the substantially conical overall shape of FIG. 8*a*.

Thus, the height H of the base 20 must be adequate for the apex A of the cone obtained to be located above the lower plane of the grid 10*a*. Preferably, A will be located, following the deposition operations described hereinbefore, above the upper plane of the grid 10*a*. For this purpose, the height H will be substantially equal to the thickness of the insulator 12, i.e. in this embodiment at the distance separating the cathode conductor 8 from the lower plane of the grid 10*a*.

If a resistive layer is intercalated between the microtips and the cathode conductors, it is obviously necessary to take account of the thickness of said resistive layer.

It is then possible to carry out the cleaning and finishing operations described hereinbefore. As a result of the initial choice of materials from which the parts 20 and 22 are made, the only part etched by the finishing operation is part 22. The structure obtained by the process (FIGS. 8*b* or 8*c*) has the following form:

- a first, substantially truncated cone-shaped part of height H, H being preferably substantially equal to the distance separating the cathode conductor 8 from the lower plane I of the grid 10*a*, i.e. substantially equal to the thickness e of the insulator 12, e.g. H between 0.8*e* and 1.1*e* (here again it is necessary to take account of the possible presence of a resistive layer between the microtips and the cathode conductors);
- a second conical part, whose base is of diameter d smaller than the diameter D of the upper section of the truncated cone 20.

Figure 8B:
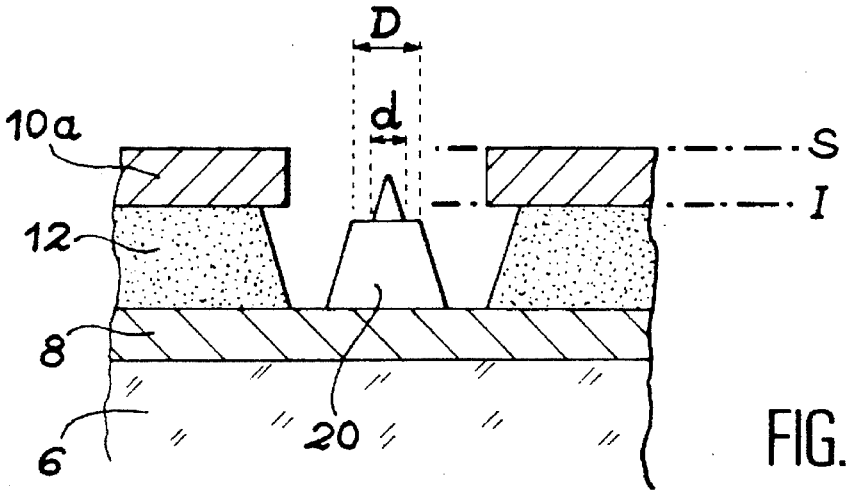
Figure 8C:
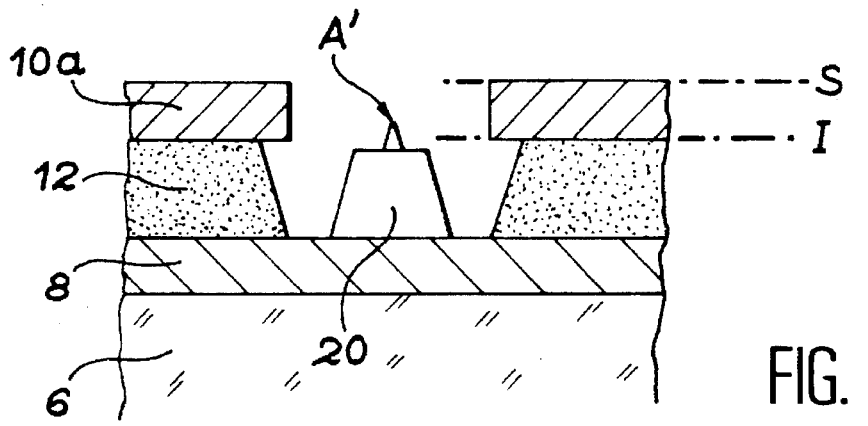

The time during which finishing takes place must be adequate to obtain the sought radius of curvature (FIG. 8*b*). However, if said time is longer, the apex 8' of the tip still remains above the lower plane of the grid 10*a*, because the part 22, etched by the finishing operation, rests on the part 20, which has not been etched by the finishing operation. Thus, the tip would only disappear after a much longer etching time.

According to a non-limitative embodiment:

- the insulator is of silica and has a thickness close to 1 μm,
- the grid is of niobium (Nb) with an approximate thickness of 0.4 μm, the holes in the grid having a diameter of approximately 1.4 μm,
- the metal constituting the base 20 of the tip is of niobium and has a thickness between 0.8 and 1.1 μm,
- the part 22 is of molybdenum with an adequate thickness to constitute the tip, e.g. 1 μm before finishing, the finishing of said part can take place in the same way as described hereinbefore in the case where the microtips are entirely of molybdenum.

Finally, a microtip cathode obtained by the method described in the present invention can be associated with a structure having at least one anode and a cathodoluminescent material for producing a display as described in U.S.

Pat. Nos. 4,857,161 (FR-A-2 593 953), 4,940,916, 5,225,820 (FR-A-2 633 763) or 5,194,780 (FR-A-2 663 462).

We claim:

1. Process for the production of an electron source comprising a system of cathode conductors, grids superimposed with an intermediate insulator and microtips, the grids being geometrically located between a lower plane and an upper plane, the microtips undergoing:

a first cleaning stage comprising a first, wet chemical cleaning substage and/or a second plasma cleaning substage, a finishing stage by surface etching.

2. Process according to claim 1, the finishing stage being followed by a second cleaning stage consisting of a wet chemical cleaning.

3. Process according to claim 1, wherein the plasma cleaning uses an oxygen plasma.

4. Process according to claim 1, the chemical cleaning being carried out in a basic lye bath.

5. Process according to claim 1, the surface etching finishing stage being performed by any of the methods from among controlled chemical or electrochemical etching, reactive ionic etching and ionic bombardment.

6. Process according to claim 5, the finishing stage being a reactive ionic etching stage based on a $SF_6$ plasma.

7. Process according to any one of the 1,2 and 4–6 the surface etching of the microtips being performed over a thickness of a few dozen to a few thousand Angstroms.

8. Process for the production of a display means by cathodoluminescence, involving the production of an electron source by a process according to claim 7.

9. Process according to any one of the 1,2 and 4–6 characterized in that, prior to the cleaning and finishing stages, the microtips are respectively produced in at least two parts:

a first part serving as a base and made from a first conductor material chosen in such a way that it is not or is only very slightly etched by the finishing stage, a second part constituting the actual tip and deposited on the first part, said second part being made from a second conductor material chosen in such a way that it is etched by the finishing stage.

10. Process according to claim 9, the base being of height such that its apex is substantially at the same level as the lower plane of the grids.

11. Process according to claim 9, the first part being of niobium (Nb).

12. Process according to claim 9, the second part being of molybdenum (Mo), chromium (Cr), silicon (Si), iron (Fe) or nickel (Ni).

13. Process for the production of a display means by cathodoluminescence, involving the production of an electron source by a process according to claim 9.

14. Process for the production of a display means by cathodoluminescence, involving the production of an electron source by a process according to any one of the claims 1,2 and 4–6.

15. Microtip electron source comprising a system of cathode conductors, grids superimposed with an intermediate insulator and microtips deposited in holes made in the grids and the insulator, the grids being geometrically located between a lower plane and an upper plane, the microtips respectively comprising at least two parts:

a first, truncated cone-shaped part of height and made from a first conductor material, a second part, constituting a conical tip and deposited on the first part, being made from a second conductor material, the first and second materials being chosen in such a way that the second material can be finished by selective etching with respect to the first material.

16. Microtip electron source according to claim 13, the selective etching being controlled chemical or electrochemical etching, reactive ionic etching or ionic bombardment.

17. Microtip electron source according to either of the claims 13 and 14, the height of the first part being such that its apex is substantially at the same level as the lower plane of the grids.

18. Microtip electron source according to any one of the claim 15 or 16, the first part being made from niobium (Nb).

19. Microtip electron source according to any one of the claims 15 or 16, the second part being made from molybdenum (Mo), silicon (Si), chromium (Cr), iron (Fe) or nickel (Ni).

20. Display means by cathodoluminescence, characterized in that it has a microtip electron source according to any one of the claims 15 or 16.

* * * * *